US009937514B2

(12) United States Patent
Gould et al.

(10) Patent No.: US 9,937,514 B2
(45) Date of Patent: Apr. 10, 2018

(54) FLUID APPLICATOR HAVING A VALVE MODULE WITH A FLOATING MEMBER AND THE VALVE MODULE

(71) Applicant: NORDSON CORPORATION, Westlake, OH (US)

(72) Inventors: Mark Aaron Gould, Gainesville, GA (US); Laurence B. Saidman, Duluth, GA (US)

(73) Assignee: Nordson Corporation, Wes, OH (US)

( * ) Notice: Subject to any disclaimer, the term of this patent is extended or adjusted under 35 U.S.C. 154(b) by 30 days.

(21) Appl. No.: 15/264,589

(22) Filed: Sep. 13, 2016

(65) Prior Publication Data

US 2018/0071769 A1 Mar. 15, 2018

(51) Int. Cl.

| | |
|---|---|
| ***B67D 3/00*** | (2006.01) |
| ***B67D 7/06*** | (2010.01) |
| ***B05C 5/02*** | (2006.01) |
| ***B05C 11/10*** | (2006.01) |

(52) U.S. Cl.

CPC ..... *B05C 5/0225* (2013.01); *B05C 11/1028* (2013.01)

(58) Field of Classification Search

CPC ..... B05C 5/0225; B05C 11/1028

USPC ..... 222/532, 67, 62, 504; 141/199; 137/409, 137/410

See application file for complete search history.

(56) References Cited

U.S. PATENT DOCUMENTS

| | | | | |
|---|---|---|---|---|
| 3,229,854 | A * | 1/1966 | Turnquist | C02F 1/686 137/268 |
| 5,458,168 | A * | 10/1995 | Lindgren | B67C 11/063 141/199 |
| 9,789,511 | B2 * | 10/2017 | Aguilar | B05C 5/0225 |
| 9,821,323 | B2 * | 11/2017 | Ikushima | B05B 1/02 |
| 2017/0333923 | A1 * | 11/2017 | Haffley | B05B 1/306 |

* cited by examiner

*Primary Examiner* — Jeremy W Carroll
(74) *Attorney, Agent, or Firm* — Baker & Hostetler LLP

(57) ABSTRACT

A valve module with floating member for use in a fluid applicator and a fluid applicator comprising said valve module are disclosed. The fluid applicator further includes a valve module that is configured to control a flow of fluid from the chamber to the cavity. The valve module includes an upper valve seat and a valve stem operatively coupled to the drive pin and extending from the chamber to the cavity. The valve module further includes a retaining tip attached to the valve stem and a floating member disposed in the cavity between the opening and the retaining tip such that the valve stem passes through the floating member and the floating member is movable along a longitudinal axis of the valve stem.

20 Claims, 4 Drawing Sheets

FLUID APPLICATOR HAVING A VALVE MODULE WITH A FLOATING MEMBER AND THE VALVE MODULE

TECHNICAL FIELD

The present disclosure generally relates to fluid applicators having a valve module and more particularly to a valve module with a floating member for use in a fluid applicator.

BACKGROUND

Fluid applicators are used in a variety of applications in which a fluid, such as an adhesive, is dispensed onto a substrate in discrete quantities. In many such applications, the fluid is dispensed according to specific requirements and precise tolerances with respect to quantity and area of coverage. Accordingly, it is desirable to dispense the fluid in consistent quantities throughout a discrete dispensing operation.

Some conventional fluid applicators have a valve stem with a valve body or ball on its distal end that is disposed on an upstream side of a valve seat. In operation, the valve ball is moved in an upstream direction to open the valve and in a downstream direction to close the valve. With this type of fluid applicator, when the valve opens, the valve ball is moving in an upstream direction against the direction of fluid flow and has a tendency to delay and disrupt the flow of fluid out of the dispensing nozzle. Similarly, when the valve closes, the valve ball is moving in the downstream direction with the direction of fluid flow and the upstream valve ball has a tendency to cause a small additional quantity of fluid to be dispensed.

In order to dispense fluid with sharply defined boundaries and with consistent quantity and area of coverage, it is necessary that the motion of the valve ball be very fast, and the fluid flow be abruptly started and stopped to obtain sharp, square, cut-on and cut-off edges. Thus, the tendency of the upstream valve ball to dispense even small quantities of fluid after the gun and valve have been shut off is undesirable.

To account for the aforementioned deficiencies of the upstream valve ball type of fluid applicator, "snuff-back" valves have been developed to buffer or capture any stringing material or other post shut-off fluid flow before it is undesirably deposited on the substrate. In one such snuff-back valve, a valve tip is disposed in a cavity on a downstream side of a valve seat. The valve tip is moved in the downstream direction away from the valve seat to open the valve and allow fluid to flow into the cavity. From the cavity, the fluid then passes through a fluid outlet in the cavity and thereby is dispensed onto a substrate. To close the valve, the valve tip is moved in the upstream direction toward the valve seat. Consequently, as the valve opens, the valve tip is moving in the same downstream direction as the viscous fluid and the fluid begins to be dispensed simultaneously with the opening of the valve tip. When the valve closes, the valve tip is moving in the upstream direction and is effective to sharply cut-off the flow of viscous fluid.

While such snuff-back valves operate effectively to provide sharper cut-on and cut-off of fluid flow, they may suffer from an undesirable effect known in the industry as "hammerhead." Hammerhead occurs when the initial quantity of dispensed fluid is significantly and undesirably greater than the quantity of fluid dispensed during the remainder of the dispensing operation. For example, in a dispensing operation for a linear application of fluid, the hammerhead effect may cause an undesirable "blob" of fluid at the beginning of the line of fluid while the rest of the line comprises the desired quantity and coverage of fluid. In the above-described type of snuff-back valve, the hammerhead effect is caused by a pressure in the cavity resulting from the initial downward movement of the valve tip during the start of a dispensing operation. In other words, in the initial moments of a dispensing operation, as the cavity fills with fluid and the valve tip continues to move further downward into the cavity, the resultant pressure in the cavity causes a large initial quantity of fluid to be dispensed from the fluid outlet in the cavity (i.e., the aforementioned hammerhead effect).

These and other shortcomings are addressed in the present disclosure.

SUMMARY

Disclosed herein is a fluid applicator having a valve module with a floating member. In one embodiment, a fluid applicator comprises a chamber, an actuator, and an inlet that supplies the chamber with fluid. A drive pin having a longitudinal axis is coupled to the actuator and the drive pin is configured for reciprocal movement along the drive pin's longitudinal axis. The fluid applicator further comprises a cavity in fluid communication with the chamber. The cavity has an outlet through which the fluid is dispensed. The valve module is configured to control a flow of fluid from the chamber to the cavity. The valve module comprises an upper valve seat and a valve stem having a longitudinal axis and being connected to the drive pin. The valve stem extends from the fluid chamber to the cavity. The valve module further comprises a retaining tip attached to the valve stem. The valve module further comprises a floating member disposed in the cavity between the upper valve seat and the retaining tip such that the valve stem passes through the floating member and the floating member is movable along the longitudinal axis of the valve stem.

A valve module for controlling a flow of fluid from a chamber of a fluid applicator to a cavity of the fluid applicator having a outlet through which the fluid is dispensed is further disclosed. The valve module includes an upper valve seat and a valve stem having a longitudinal axis and being configured for reciprocal movement along the valve stem's longitudinal axis. The valve stem extends from the chamber to the cavity. The valve module additionally includes a retaining tip attached to the valve stem and a floating member disposed in the cavity between the upper valve seat and the retaining tip, wherein the valve stem passes through the floating member and the floating member is movable along the longitudinal axis of the valve stem.

In the above fluid applicator or valve module, the valve module has a closed position and the floating member is flush with the upper valve seat and the retaining tip while the valve module is in the closed position. Further, the valve module has a first open position and the floating member is configured to remain flush with the retaining tip and disengage with the upper valve seat when the valve stem moves away from the upper valve seat during a transition of the valve module from the closed position to the first open position. Additionally, the valve module has a second open position occurring after the first open position and the floating member is configured to disengage with the retaining tip and move toward the upper valve seat in the second open position and when a fluid pressure in the cavity exceeds a fluid pressure in the chamber. Further, the valve module has a third open position occurring after the second open position and, in the third open position, the floating member is configured to remain disengaged from the retaining tip and re-engage with the upper valve seat due to the fluid pressure in the cavity exceeding the fluid pressure in the chamber. Yet further, the valve module has a fourth open position occurring after the third open position and, in the fourth open position, the floating member is configured to disengage from the upper valve seat and float between the upper valve seat and the retaining tip when the valve stem stops and the fluid pressure in the cavity equals the fluid pressure in the chamber. The valve module has a fifth open position occurring after the fourth open position and, in the fifth open position, the floating member is configured to engage with the retaining tip when the fluid pressure in the cavity exceeds the fluid pressure in the chamber and until the floating member is returned to the closed position.

In some embodiments, a spacing is defined between an inner surface of the floating member and the valve stem. The valve stem has a terminal end and the retaining tip is attached to the terminal end of the valve stem. The retaining tip includes a conical bottom surface and a flat upper surface generally perpendicular to the longitudinal axis of the valve stem. The cavity includes a lower valve seat wherein the conical bottom surface of the retaining tip is generally parallel with the surface of the lower valve seat of the cavity.

The diameter of a portion of the valve stem upon which the floating member is positioned is less than the diameter of a portion of the drive pin within the chamber.

Various additional features and advantages will become more apparent to those of ordinary skill in the art upon review of the following detailed description of the illustrative embodiments taken in conjunction with the accompanying drawings.

BRIEF DESCRIPTION OF THE DRAWINGS

The following detailed description is better understood when read in conjunction with the appended drawings. For the purposes of illustration, examples are shown in the drawings; however, the subject matter is not limited to the specific elements and instrumentalities disclosed. In the drawings.

DETAILED DESCRIPTION

Figure 1:
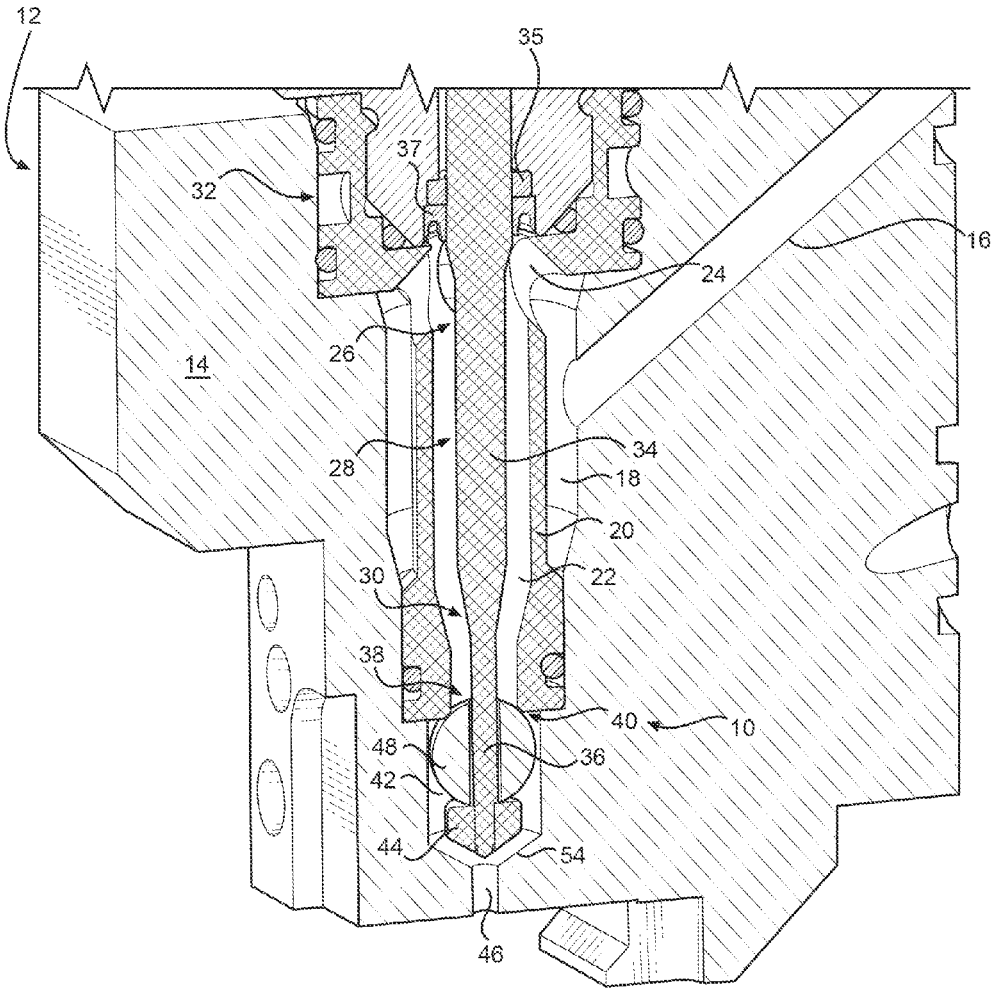
FIG. 1 illustrates a fluid applicator according to an embodiment of the present disclosure.

FIGS. 1-7 illustrate an exemplary embodiment of a fluid applicator 12 having a valve module 10. The fluid applicator 12 is configured to dispense small, intermittent quantities of a fluid, such as an adhesive. The fluid applicator 12 includes a body 14 in which the valve module 10 and other various dispensing mechanisms are disposed. A fluid inlet 16, disposed within the body 14, supplies an outer fluid chamber 18 with a pressurized fluid. The outer fluid chamber 18 is defined on its outer perimeter by the body 14 and on its inner perimeter by an outer surface of a divider 20, of which the outer fluid chamber 18 annularly surrounds. The outer fluid chamber 18 is fluidly connected to an inner fluid chamber 22 via one or more passageways 24. The inner fluid chamber 22 is generally defined by an inner surface of the divider 20. Accordingly, the outer fluid chamber 18 concentrically surrounds the inner fluid chamber 22. In an alternative embodiment, the outer fluid chamber 18 may be omitted entirely and the fluid inlet 16 may instead connect directly to the inner fluid chamber 22.

The inner fluid chamber 22 includes an upper portion 26, a middle portion 28, and a lower portion 30. The upper portion 26 includes the openings to the passageways 24 through which fluid is received from the outer fluid chamber 18. The upper portion 26 further abuts on its upper-most end with the body of an actuator 32 providing a reciprocal movement of a drive pin 34 and valve stem 36 and thus effectuating the operation of the valve module 10, as will be discussed in greater detail below. A sealing assembly including a backup ring 35 (e.g., a rubber O-ring) and a spring-energized lip seal 37 provides a fluid seal with the drive pin 34, sealing and isolating the upper portion 26 of the inner fluid chamber 22 (and the inner fluid chamber 22 in general) from the actuator 32.

The drive pin 34 is operatively coupled with the actuator 32, which causes movement of the drive pin 34 and valve stem 36 along their respective longitudinal axes. The actuator 32 may comprise, for example, a piezoelectric actuator, a pneumatic actuator, a solenoid actuator, or any other type of suitable actuator. The drive pin 34 extends through the inner fluid chamber 22 and includes the valve stem 36 at the position generally corresponding to the valve module 10. While the drive pin 34 and the valve stem 36 are integrally formed in the embodiment shown in FIG. 1, the drive pin 34 and the valve stem 36 may instead be formed as separate, operatively coupled components. The diameter of the valve stem 36 is less than the diameter of the drive pin 34. In particular, the diameter of the portion of the valve stem 36 upon which the floating member 48 moves is less than the diameter of the portion of the drive pin 34 that is inside the inner fluid chamber 22.

The middle portion 28 of the inner fluid chamber 22 is formed in an elongate, cylindrical shape and narrows to the lower portion 30 of the inner fluid chamber 22. The lower portion 30 of the inner fluid chamber 22 adjoins, at the perimeter of an opening 38 defining an upper valve seat 40, a cavity 42. As will be discussed in greater detail below, the cavity 42 receives fluid from the inner fluid chamber 22 upon disengagement of the floating member 48 and the upper valve seat 40. The cavity 42 in the depicted embodiment is defined by the body 14 of the fluid applicator 12. The cavity 42 is in fluid communication with a fluid outlet 46 disposed at the bottom of a lower valve seat 54 defining the bottom end of the cavity 42. The fluid outlet 46, in turn, leads to the exterior of the fluid applicator 12 whereat a substrate may be positioned to receive the fluid dispensed from the fluid outlet 46.

The valve stem 36 extends through the opening 38 of the upper valve seat 40 and includes a retaining tip 44 on the valve stem's 36 terminal end. The retaining tip 44 serves, at least in part, to restrict the downward movement of a floating member 48 movably disposed on the valve stem 36. The retaining tip 44 is generally cylindrical- or disc-shaped and includes a flat upper surface 50, the plane of which is generally perpendicular to the longitudinal axis of the valve stem 36. The bottom surface 52 of the retaining tip 44 is formed in a generally conical shape such that the bottom surface 52 is generally parallel with the surface of the lower valve seat 54 of the cavity 42. In some aspects, the retaining tip 44 may be integrally formed with the valve stem 36.

The spherical floating member 48 is positioned on the valve stem 36 such that the valve stem 36 passes through a hole 56 in the floating member 48. The valve stem 36 and/or the hole 56 in the floating member 48 are sized or otherwise configured for the floating member 48 to freely move up and down on the valve stem 36 according to the various pressures (described in detail below) exerted on the floating member 48 by the flow of the fluid in the valve module 10 and subject to the bounds imposed by the retaining tip 44 below the floating member 48 and the upper valve seat 40 above the floating member 48. In the embodiment shown, a spacing 58 is created between the valve stem 36 and an inner surface 57 of the floating member 48, thus allowing some fluid to pass therethrough when the valve module 10 is in an open position. In other aspects, the inner surface of the floating member 48 may be flush against the valve stem 36 (yet still movable), thereby precluding the spacing 58.

The floating member 48 and the upper valve seat 40 are cooperatively configured to provide a fluid seal between the inner fluid chamber 22 and the cavity 42 when the floating member 48 is retained flush against the upper valve seat 40 by the upward movement or force imparted by the retaining tip 44 of the valve stem 36. Similarly, the contact between the floating member 48 and the upper surface 50 of the retaining tip 44 prevents the flow of any fluid from within the spacing 58 between the inner surface 57 of the floating member 48 and the valve stem 36.

Figure 2:
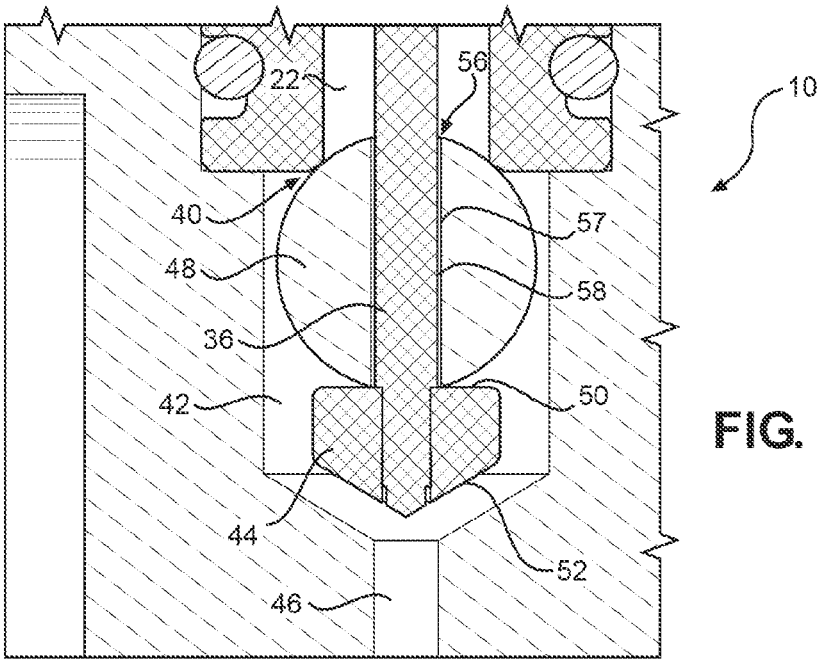
FIGS. 2-7 illustrate a close-up view of the valve module in various positions.

FIGS. 2-7 illustrate a close-up side view of the valve module 10 in various states during a dispensing operation. In FIG. 2, the valve module 10 is depicted in a closed position. The valve stem 36 is held at its upper-most position by operation of the actuator 32 and/or the biasing element 37. Accordingly, the floating member 48 is positioned in contact with the upper valve seat 40 to provide a fluid seal and thereby prevent the flow of fluid from the inner fluid chamber 22 into the cavity 42. The floating member 48 is also held in contact with the upper surface 50 of the retaining tip 44 to prevent fluid flow from the spacing 58 between the valve stem 36 and the inner surface 57 of the floating member 48.

Figure 3:
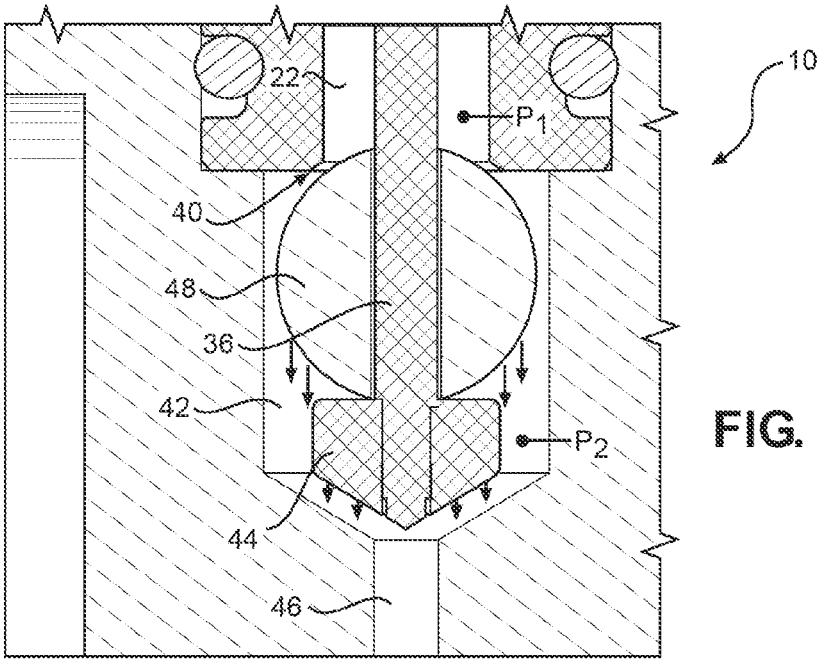

In FIG. 3, the process of opening the valve module 10 is initiated. Namely, in a first open position, driven by the actuator 32, the valve stem 36 and the attached retaining tip 44 move downward toward the fluid outlet 46. Under a supply pressure $P_1$ in the inner fluid chamber 22, the floating member 48 is forced downward in conjunction with the retaining tip 44 and out of engagement with the upper valve seat 40. Since the floating member 48 is disengaged with the upper valve seat 40, the fluid from the inner fluid chamber 22 begins to flow into the cavity 42, thereby affecting a cavity pressure $P_2$ in the cavity 42.

Figure 4:
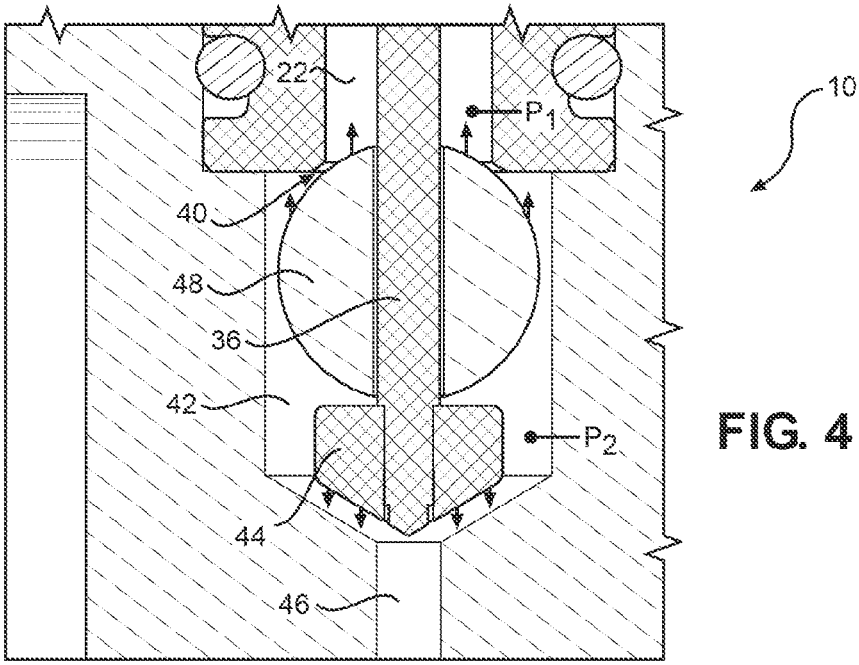

In FIG. 4 and in a second open position, the floating member 48 begins to move back upwards towards the upper valve seat 40. This occurs when the cavity pressure $P_2$ in the cavity 42, increased by the flow of fluid from the inner fluid chamber 22 and the downward movement of the valve stem 36 and the retaining tip 44 (which positively displace additional fluid), exceeds the supply pressure $P_1$ in the inner fluid chamber 22.

Figure 5:
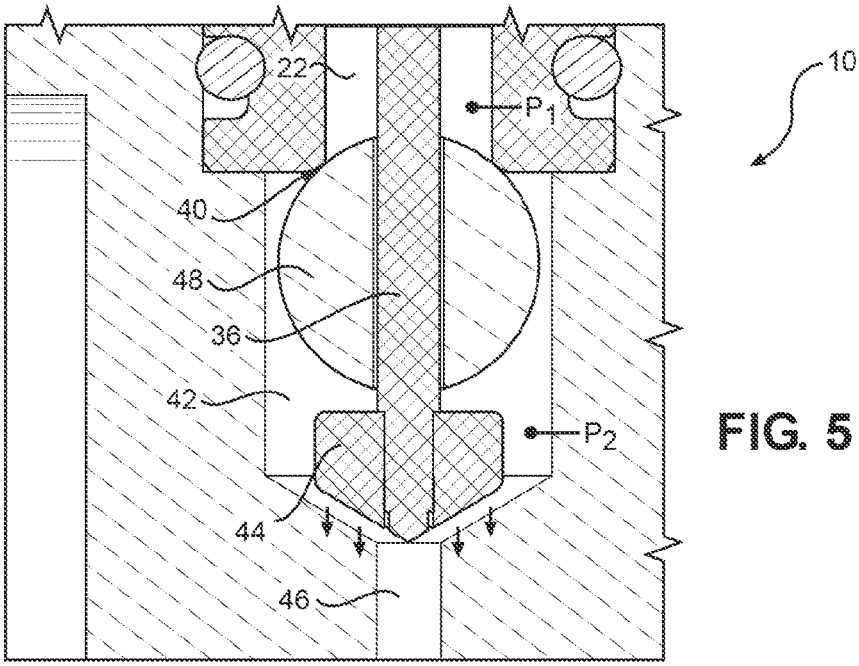

In FIG. 5 and in a third open position, the retaining tip 44 and valve stem 36 continue to move downward toward the fluid outlet 46 and the floating member 48 re-seats with the upper valve seat 40 due to the higher cavity pressure $P_2$ in the cavity 42 relative to the supply pressure $P_1$. The cavity pressure $P_2$ exceeding the supply pressure $P_1$ is caused by the positive displacement of the retaining tip 44, which at the typical opening velocity is greater than a steady state flow through the cavity 42. During this time in which the floating member 48 is reseated with the upper valve seat 40 and the valve stem 36 and retaining tip 44 are still moving downward, the flow of fluid from the cavity 42 and through the fluid outlet 46 is driven primarily by the movement of the valve stem 36 and the retaining tip 44. Notably, the floating member 48 moving upwards and re-engaging the upper valve seat 40 due to the cavity pressure $P_2$ being greater than the supply pressure $P_1$, as shown in FIGS. 4 and 5, serves to prevent or lessen the aforementioned "hammerhead" effect (i.e., the undesirable and disproportionately large quantity of fluid dispensed at the start of a dispensing operation) by restricting fluid flow from the inner fluid chamber 22 until the cavity pressure $P_2$ is reduced to a level equaling that of the supply pressure $P_1$.

Figure 6:
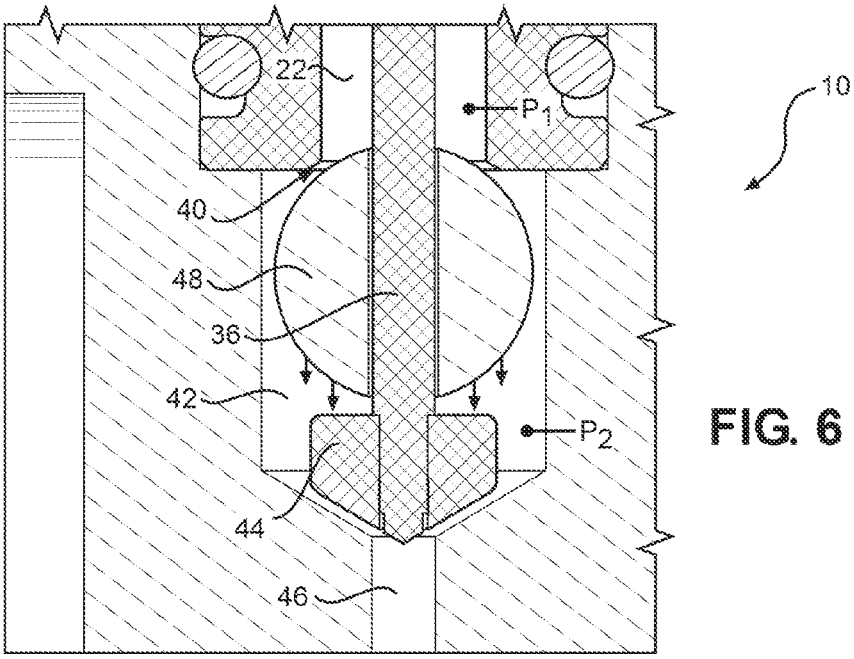

In FIG. 6 and in fourth open position, the valve stem 36 and retaining tip 44 reach their lower-most position and stop their downward movement. The cavity pressure $P_2$ equalizes with the supply pressure $P_1$ since there is no longer a positive displacement of fluid caused by motion of the valve stem 36 and the retaining tip 44. Accordingly, the floating member 48 disengages with the upper valve seat 40 and moves downward until coming into contact with the retaining tip 44 as fluid flows past the floating member 48 in the cavity 42 and through the fluid outlet 46.

In a fifth open position (not shown), the floating member 48 engages with and remains in contact with the retaining tip 44 until the end of the dispensing operation (i.e., until the valve stem 36 and retaining tip 44 begin to move back upwards towards the upper valve seat 40). The floating member 48 is moved into engagement with the retaining tip 44 due to the cavity pressure $P_2$ continuing to increase above the supply pressure $P_1$, which is caused by the restriction between the upper valve seat 40 and the valve stem 36.

Figure 7:
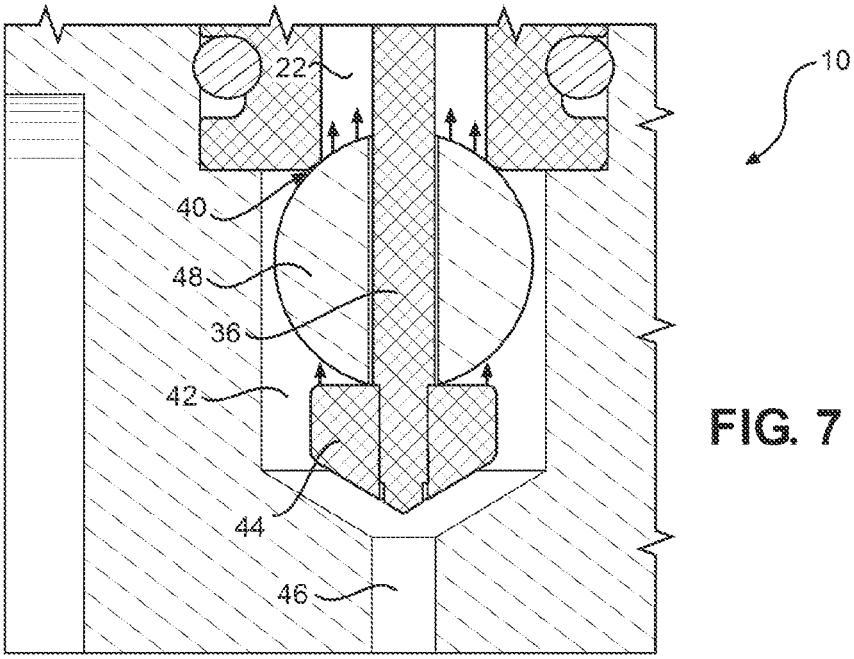

In FIG. 7, to conclude the dispensing operation, the valve stem 36 and retaining tip 44, and thereby also the floating member 48, are moved upward until the floating member 48 engages the upper valve seat 40 to stop fluid flow from the inner fluid chamber 22. The upper surface 50 of the retaining tip 44 is also brought into contact with the bottom of the floating member 48 to prevent fluid flow from the spacing 58 between the inner surface 57 of the floating member 48 and the valve stem 36.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. Use of the term "generally" or the like with respect to any characteristic shall be understood to mean a variation of plus or minus 10% with respect to that characteristic All methods described herein can be performed in any suitable order unless otherwise indicated herein or otherwise clearly contradicted by context.

What is claimed is:

1. A valve module for controlling a flow of fluid from a chamber of a fluid applicator to a cavity of said fluid applicator having an outlet through which said fluid is dispensed, said valve module comprising:

an upper valve seat;

a valve stem having a longitudinal axis, configured for reciprocal movement along said longitudinal axis, and extending from said chamber to said cavity;

a retaining tip attached to said valve stem; and a floating member disposed in said cavity between said upper valve seat and said retaining tip, wherein said valve stem passes through said floating member and said floating member is movable along said longitudinal axis of said valve stem.

2. The valve module of claim 1, wherein said valve module has a closed position and said floating member is flush with said upper valve seat and said retaining tip while said valve module is in said closed position.

3. The valve module of claim 2, wherein said valve module has a first open position and said floating member is configured to remain flush with said retaining tip and disengage with said upper valve seat when said valve stem moves away from said upper valve seat during a transition of said valve module from said closed position to said first open position.

4. The valve module of claim 3, wherein said valve module has a second open position occurring after said first open position and said floating member is configured to disengage with said retaining tip and move toward said upper valve seat in said second open position and when a fluid pressure in said cavity exceeds a fluid pressure in said chamber.

5. The valve module of claim 4, wherein said valve module has a third open position occurring after said second open position and, in said third open position, said floating member is configured to remain disengaged from said retaining tip and re-engage with said upper valve seat due to said fluid pressure in said cavity exceeding said fluid pressure in said chamber.

6. The valve module of claim 5, wherein said valve module has a fourth open position occurring after said third open position and, in said fourth open position, said floating member is configured to disengage from said upper valve seat and float between said upper valve seat and said retaining tip when said valve stem stops and said fluid pressure in said cavity equals said fluid pressure in said chamber.

7. The valve module of claim 6, wherein said valve module has a fifth open position occurring after said third open position and, in said fifth open position, said floating member is configured to engage with said retaining tip when said fluid pressure in said cavity exceeds said fluid pressure in said chamber and until the floating member is returned to said closed position.

8. The valve module of claim 1, wherein said floating member has an inner surface and a spacing is defined between said inner surface of said floating member and said valve stem.

9. The valve module of claim 1, wherein:

said cavity comprises a lower valve seat;

said valve stem comprises a terminal end; and said retaining tip is attached to said terminal end of said valve stem and comprises:

a conical bottom surface generally parallel with the surface of said lower valve seat of said cavity; and a flat upper surface generally perpendicular to said longitudinal axis of said valve stem.

10. A fluid applicator comprising:

a chamber receiving a supply of fluid;

a cavity having an outlet through which the fluid is dispensed; and a valve module according to claim 1, wherein said valve module controls the flow of fluid from said chamber to said cavity.

11. A fluid applicator comprising:

a chamber;

an inlet supplying said chamber with fluid;

an actuator;

a drive pin having a longitudinal axis and being coupled to said actuator, said drive pin configured for reciprocal movement along said longitudinal axis of said drive pin;

a cavity in fluid communication with said chamber, said cavity having an outlet through which said fluid is dispensed; and a valve module configured to control a flow of fluid from said chamber to said cavity, said valve module comprising:

an upper valve seat;

a valve stem having a longitudinal axis and being connected to said drive pin and extending from said chamber to said cavity;

a retaining tip attached to said valve stem; and a floating member disposed in said cavity between said upper valve seat and said retaining tip, said valve stem passes through said floating member and said floating member is movable along said longitudinal axis of said valve stem.

12. The fluid applicator of claim 11, wherein said valve module has a closed position and said floating member is flush with said upper valve seat and said retaining tip while said valve module is in said closed position.

13. The fluid applicator of claim 12, wherein said valve module has a first open position and said floating member is configured to remain flush with said retaining tip and disengage with said upper valve seat when said valve stem moves away from said upper valve seat during a transition of said valve module from said closed position to said first open position.

14. The fluid applicator of claim 13, wherein said valve module has a second open position occurring after said first open position and said floating member is configured to disengage with said retaining tip and move toward said upper valve seat in said second open position and when a fluid pressure in said cavity exceeds a fluid pressure in said chamber.

15. The fluid applicator of claim 14, wherein said valve module has a third open position occurring after said second open position and, in said third open position, said floating member is configured to remain disengaged from said retaining tip and re-engage with said upper valve seat due to said fluid pressure in said cavity exceeding said fluid pressure in said chamber.

16. The fluid applicator of claim 15, wherein said valve module has a fourth open position occurring after said third open position and, in said fourth open position, said floating member is configured to disengage from said upper valve seat and move towards said retaining tip when said valve stem stops and said fluid pressure in said cavity equals said fluid pressure in said chamber.

17. The fluid applicator of claim 16, wherein said valve module has a fifth open position occurring after said fourth open position and, in said fifth open position, said floating member is configured to engage with said retaining tip when said fluid pressure in said cavity exceeds said fluid pressure in said chamber and until the floating member is returned to said closed position.

18. The fluid applicator of claim 11, wherein said floating member has an inner surface and a spacing is defined between said inner surface of said floating member and said valve stem.

19. The fluid applicator of claim 11, wherein:

said cavity comprises a lower valve seat;

said valve stem comprises a terminal end; and said retaining tip is attached to said terminal end of said valve stem and comprises:

a conical bottom surface generally parallel with the surface of said lower valve seat of said cavity; and a flat upper surface generally perpendicular to said longitudinal axis of said valve stem.

20. The fluid applicator of claim 11, wherein the diameter of a portion of said valve stem upon which said floating member is positioned is less than the diameter of a portion of said drive pin within said chamber.

* * * * *